US005330279A

United States Patent [19]

Ruble

[11] Patent Number: 5,330,279

[45] Date of Patent: Jul. 19, 1994

[54] OVERLAY BINDER INCLUDING EASY-RELEASE LABEL LEADER

[76] Inventor: Paul E. Ruble, 249 Devia Dr., Newbury Park, Calif. 91320

[21] Appl. No.: 1,180

[22] Filed: Jan. 7, 1993

[51] Int. Cl.[5] ..... B42F 13/40; B42D 3/00; B42D 3/18

[52] U.S. Cl. ..... 402/3; 402/73; 402/80 R; 281/15.1; 281/29; 281/36; 281/37

[58] Field of Search ..... 402/3, 73, 80 R; 281/15.1, 29, 31, 36, 37

[56] References Cited

U.S. PATENT DOCUMENTS

| | | | |
|---|---|---|---|
| 1,677,277 | 7/1928 | Federbush et al. | 402/3 |
| 1,805,314 | 5/1931 | Morton | 402/3 |
| 3,186,114 | 6/1965 | Carter | 402/3 |
| 3,663,041 | 5/1972 | White | 281/46 |
| 3,814,527 | 6/1974 | Lawes | 402/3 |
| 4,070,223 | 1/1978 | Stalzer | 282/DIG. 2 |
| 4,448,558 | 5/1984 | Weingarten | 282/DIG. 2 |
| 4,596,482 | 6/1986 | Salzer | 402/3 |
| 4,681,472 | 7/1987 | Ruble | 402/3 |
| 4,848,799 | 7/1989 | Turetsky | 281/42 |
| 4,892,333 | 1/1990 | Krulich | 281/31 |
| 4,998,840 | 3/1991 | Ruble | 402/3 |

FOREIGN PATENT DOCUMENTS

| | | | |
|---|---|---|---|
| 1536573 | 1/1970 | Fed. Rep. of Germany | 402/3 |
| 2656021 | 6/1978 | Fed. Rep. of Germany | 402/3 |
| 313576 | 6/1956 | Switzerland | 402/3 |

*Primary Examiner*—Paul A. Bell
*Attorney, Agent, or Firm*—Koppel & Jacobs

[57] ABSTRACT

A loose-leaf binder (40) or other bound work has a slot (44) defined between the outer surface of a cover or spine (48) thereof, and a transparent overlay (46) attached over the spine (48) into which a label (54) can be inserted. The overlay (46) is sealed to the spine (48) along its longitudinal edges. An elongated, flexible label leader (42) extends through the slot (44) and protrudes therefrom at its opposite ends. An adhesive portion (52) is formed on a surface (**42*e*) of an end portion (42*b*) of the leader (42). The label (54) may be inserted into the slot (44) by releasably adhering an end of the label (54) to the adhesive portion (52) of the leader (42), and pulling on an opposite end portion (42*c*) of the leader (42), thereby pulling the attached label (54) into the slot (44). A loop portion (42*f*) extends from the end portion (42*b*) of the leader (42), and is folded back and adhered to an opposite surface (42*d*) of the end portion (42*b*). Part of the loop portion (42*f*) protrudes from the slot (44) when the label (54) is fully inserted, and is pulled to smoothly peel the adhesive portion ( 52 ) from the label ( 54 ) and detach the leader (42) from the label (54) and binder (40**).

15 Claims, 3 Drawing Sheets

OVERLAY BINDER INCLUDING EASY-RELEASE LABEL LEADER

BACKGROUND OF THE INVENTION

1. Field of the Invention

The present invention relates to an improved label leader and method for inserting a label into a slot of an overlay on a bound work such as a loose-leaf binder.

2. Description of the Related Art

The present invention constitutes an improvement to my "SELF-LOADING BINDER" disclosed in U.S. Pat. No. 4,681,472, issued Jul. 21, 1987. The invention is also compatible with my "METHOD AND TOOL FOR RETROFITTING AN ELONGATED LABEL LEADER INTO THE SLOT OF AN OVERLAY BINDER", disclosed in U.S. Pat. No. 4,998,840, issued Mar. 12, 1991.

Loose-leaf binders and other bound works may be conveniently provided with transparent overlays on the spines thereof which are sealed along their longitudinal edges to the spine. An elongated pocket or slot is defined between the cover and spine into which a label may be inserted to identify the contents of the bound work. This arrangement is highly preferable to conventional expedients such as affixing an adhesive label to the outer surface of the spine, since a label attached in the present manner is protected from wear and tear by the durable overlay.

Without the improvements disclosed in my prior patents, a label is difficult to insert into such a slot due to the length of the slot, and the fact that the overlay fits tightly over the spine. Attempts to insert a label into the slot will generally result in folds being created in the center portion of the label by the force used to push the label into the slot. Additional damage may also be done to the binder spine and/or overlay if a pen, paper clip, or similar sharp object is used to force the label into the slot.

The arrangement disclosed in my prior patents is illustrated in FIGS. 1 and 2. A bound work, here shown as being a loose-leaf binder 10, includes an end cover or spine 12, and front and rear covers 14 and 16 which are attached to the spine 12 along longitudinal edges 18 and 20 thereof respectively. A transparent overlay 22 is sealed to the spine 12 along or adjacent to the longitudinal edges 18 and 20 to define a pocket or slot 24 between itself and the surface of the spine 12.

In order to enable a label made of flexible paper or the like to be inserted into the slot 24 for identification of the contents of the binder 10, a thin, flexible leader 26 extends through the slot 24 and protrudes therefrom at its opposite ends. As viewed in FIG. 1, the upper end of the leader 26 has a releasable adhesive portion 28 formed thereon which faces away from the binder 10. The leader 26 is long enough so that the ends thereof may be folded back over the spine 20, with the adhesive portion 28 on the upper end being releasably adhered to the facing surface of the lower end of the leader 26 as illustrated in FIG. 2. The ends of the leader 26 are thereby secured together in a convenient and compact manner over the spine 26 of the binder 10 for storage, shipping and sales.

FIGS. 3*a* to 3*d* are simplified diagrams illustrating how the leader 26 is used to insert a label into the slot 24 in accordance with my prior patents. These figures, as well as similar figures which will be referenced below, are not drawn to scale, but are compressed along the axis of the spine 12 to facilitate description of the invention.

As viewed in FIG. 3*a*, the lower end portion of a flexible label 30 is pressed down onto the adhesive portion 28 of the leader 26 and releasably adhered thereto. As illustrated in FIG. 3*b*, the lower end of the leader 26 is then gripped and pulled downwardly, thereby pulling the label 30 downwardly into the slot 24. FIG. 3*b* shows the label 30 as being pulled approximately half way into the slot 24, whereas in FIG. 3*c* the label 30 has been pulled all the way into the slot 24.

The leader 26 is released from the label 30 by applying finger pressure to the overlay 22 at a position such as designated by a cross 32 to immobilize the label 30, and then pulling down on the leader 26 with increased force until the adhesive portion 28 releases or detaches from the label 30 as shown in FIG. 3*d*.

Although not illustrated, the leader 26 may be used to remove the label 30 from the slot 24 by inserting the leader 26 into the upper end of the slot 24 between the spine 12 and label 30 with the adhesive portion 28 facing the label 30. Finger pressure is applied to adhere the adhesive portion 28 to the label 30. The leader 26 is then pulled upwardly, thereby pulling the label 30 out of the slot 24 through the top (opposite to the direction in which the label was inserted into the slot).

The upper and lower traverse ends of the overlay 22 may both be not sealed to the spine 12, thereby providing the slot 24 with open upper and lower ends. Alternatively, the lower transverse end of the overlay 22 may be sealed to the spine as indicated at 34, and cut away at a central portion 36 which is slightly wider than the leader 26. This provides a stop for the lower end of the label 30, while still enabling the leader 26 to protrude through both ends of the slot 24.

The directions included with overlay binders which are sold to the public including label leaders 26 as disclosed in my prior patents advise that the step of FIG. 3*d* should be performed by popping the leader 26 free of the label 30 using a gentle side to side motion. No problems are encountered if the directions are followed. However, users who do not receive or read the directions or who are careless and/or impatient tend to jerk on the leader 26 rather than detach it gently as advised.

The adhesive portion 28 must be strong enough to grip the label 30 as it is being pulled through the slot 24, and is detached from the label 30 in the step of FIG. 3*d* by shear force. If the leader 26 is jerked rather than being gently popped free, part of the label 30 can shear and be torn off by the adhesive portion 28 and detach with the leader 26. It is also possible for part of the leader 26 to be torn off and remain adhered to the label 30 by the adhesive portion 28. The appearance of the label 30 is spoiled in both cases.

SUMMARY OF THE INVENTION

The present invention overcomes the problem described above by providing a bound work including an improved label leader which can be quickly and easily detached from a label after the leader has been used for inserting the label into the slot of the bound work, even if the leader is jerked roughly by a careless user. The present invention further provides an improved method of inserting a label into the spine of a bound work using the improved label leader.

More specifically, a loose-leaf binder or other bound work embodying the invention has a slot defined between the outer surface of a spine thereof, and a transparent overlay attached over the spine, into which a label can be inserted. The cover is sealed to the spine along its longitudinal edges.

An elongated, flexible label leader is designed to extend through the slot and protrude therefrom at its opposite ends. An adhesive portion is formed on one end portion of the leader. A label may be inserted into the slot by releasably adhering an end of the label to the adhesive portion of the leader, and pulling on the other end of the leader, thereby pulling the attached label into the slot.

In accordance with the improvement of the present invention, the leader is improved for easy release or detachment from the label by further including a loop portion which is folded back over and adhered to the surface of the end portion of the leader opposite to the surface on which the adhesive portion is formed. When the label is pulled completely into the slot, part of the loop portion of the leader protrudes from the end of the slot.

The leader is detached from the label by pulling on the protruding part of the loop portion. This causes the adhesive portion of the leader to be peeled away from the label. The peeling action, as opposed to the shearing action as in the arrangement of my prior patents, enables the adhesive portion to easily and smoothly detach from the label without tearing the leader or label, even if the end of the loop portion is jerked roughly rather than being pulled gently as directed.

The end of the loop portion can be permanently adhered to the surface of the end portion of the leader. Alternatively, a tab portion can be provided which extends from the end of the loop portion. In this case, the end of the loop portion is releasably adhered to the surface of the end portion and detached therefrom by pulling the tab portion prior to detaching the leader from the label. In another embodiment of the invention, the loop portion is elongated, extends through the slot and is joined to the opposite end of the leader such that the leader constitutes a continuous loop.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
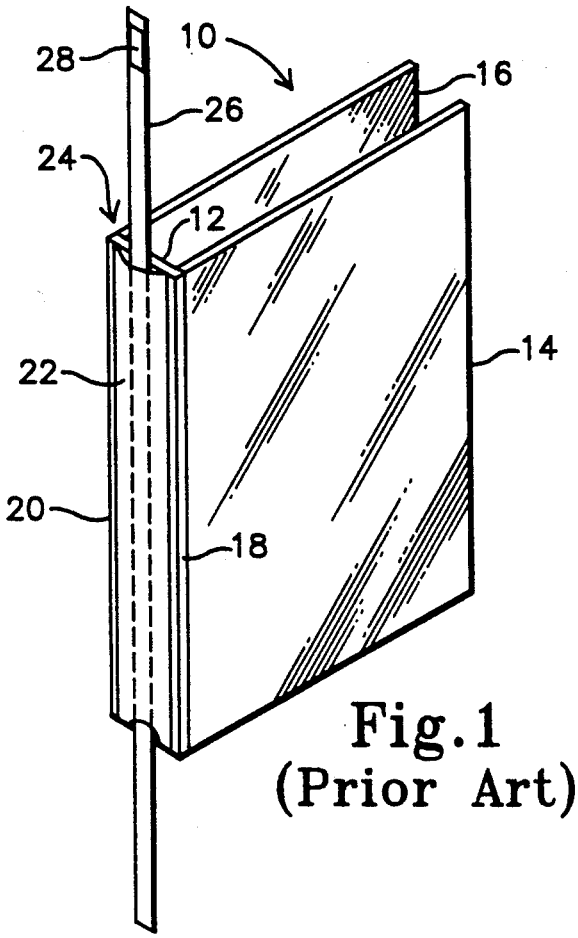
Fig.1 (Prior Art)
FIG. 1 is an isometric view of a loose-leaf binder provided with a label leader in accordance with my above referenced prior patents.
Figure 2:
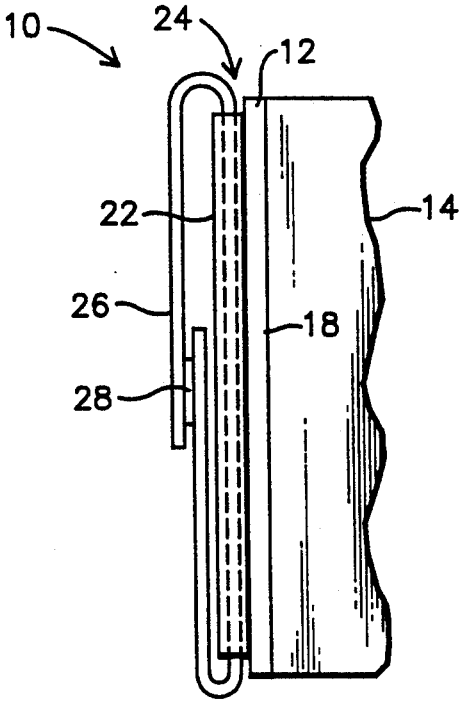
Fig.2 (Prior Art)
FIG. 2 is a side elevational view of the binder and label leader assembly shown in FIG. 1.
Figure 4A:
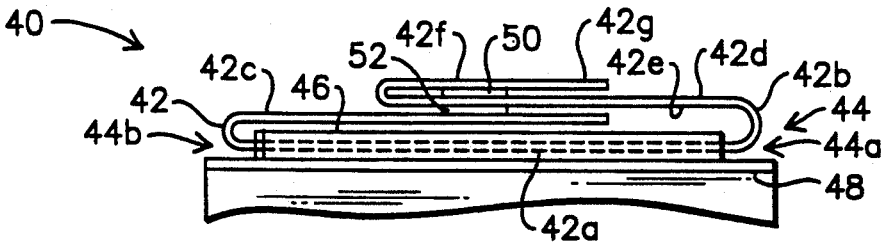
FIG. 4*a* to 4*f* are simplified side elevational views, rotated by 90° from the position of FIG. 2, illustrating a method of inserting a label into a bound work using a first embodiment of an improved label leader embodying the present invention.

Referring now to FIG. 4*a* of the drawing, a bound work or binder 40, which may be the same as described with reference to FIG. 1 above, is fitted with a first improved label leader 42 according to the present invention. The binder 40 as designed for standard loose-leaf sheets will typically have a slot 44 sized to accept flexible labels made of paper or the like which are generally undersized as compared to the length and width of the slot 44.

For one inch (2.5 cm) binders, the labels will typically be approximately 2.1 cm wide and 28 cm long. The label leader 42 may be as wide as or wider than the label, but is preferably narrower than the label, typically 8 mm wide and 63.5 cm long (exclusive of a loop portion as will be described below), and is made of a strong, yet flexible plastic or other suitable material. The binder 40 includes a transparent overlay 46 which defines the slot 44 and is sealed to a spine 48 of the binder 40 at both of its longitudinal edges.

The overlay 46 is unsealed or open at a first transverse end 44*a* of the slot 44 to enable a label to be inserted therein. The overlay 46 may be unsealed or open at a second transverse end 44*b* of the slot 44, or may be partially sealed and provided with a central opening as described with reference to FIGS. 3*a* to 3*d*. In either case, the leader 42 must be narrower than the width of the open portion of the end 44*b* of the slot 44 so that it can extend therethrough.

Although the label leader 42 is illustrated as being assembled with the binder 10 to form an integral product for sale, it may be provided as a separate salable item of manufacture and retrofit to the binder 10 in the manner described in my prior U.S. Pat. No. 4,998,840.

The label leader 42 includes a central portion 42*a* which extends through the slot 44, a first end portion 42*b* which protrudes from the first end 44*a* of the slot 44 and a second end portion 42*c* which protrudes from the second end 44*b* of the slot 44. The first end portion 42*b* has first and second opposite surfaces 42*d* and 42*e* on which first and second adhesive portions 50 and 52 are formed respectively.

The leader 42 is long enough so that the end portions 42*b* and 42*c* thereof can be folded back over the spine 48, with the second adhesive portion 52 on the first end portion 42*b* being releasably adhered to the facing surface of the second end portion 42*c* as illustrated in FIG. 4*a*. The end portions 42*b* and 42*c* of the leader 42 are thereby secured together in a convenient and compact manner over the spine 48 of the binder 40 for storage, shipping and sales.

In accordance with an improvement of the invention, the leader 42 further includes a loop portion 42*f* which extends integrally from the first end portion 42*b* and is folded back over the first surface 42*d* of the first end portion 42*b*. The first adhesive portion 50 releasably adheres the first surface 42*d* of the end portion 42*b* to the facing end of the loop portion 42*f*. A release tab 42*g* extends from the end of the loop portion 42*f*.

The adhesive portion 52 is preferably an adhesive tab which may or may not be provided with a dust cover (not shown). The adhesive portion 50 can also be an adhesive tab which is formed on either the first surface 42*d* of the second end portion 42*b* or on the facing surface of the loop portion 42*f*. Alternatively, the adhesive portion 50 can consist merely of a releasable adhesive which is applied to either or both of these surfaces and pressed therebetween during manufacture.

Figure 4B:
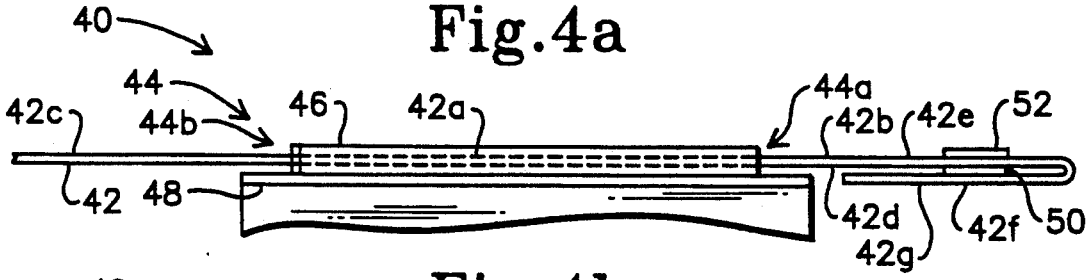
Figure 4C:
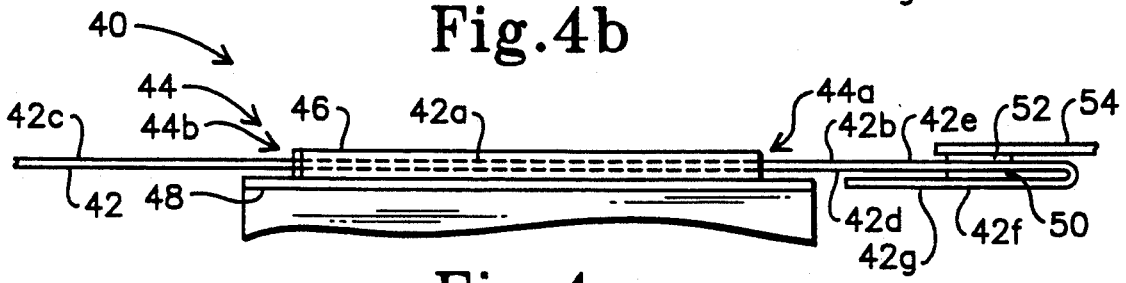

FIG. 4*b* illustrates how the leader 42 is extended for use by rotating the end portion 42*b* clockwise and rotating the end portion 42*c* counterclockwise. The adhesive portion 52 is designed to be releasable to enable the end portion 42*b* to detach from the end portion 42*c* of the leader 42. In FIG. 4*c*, the end portion of a label 54 which is to be inserted into the slot 44 is pressed down on the adhesive portion 52 and thereby attached to the end portion 42*b* of the leader 42.

Figure 4D:
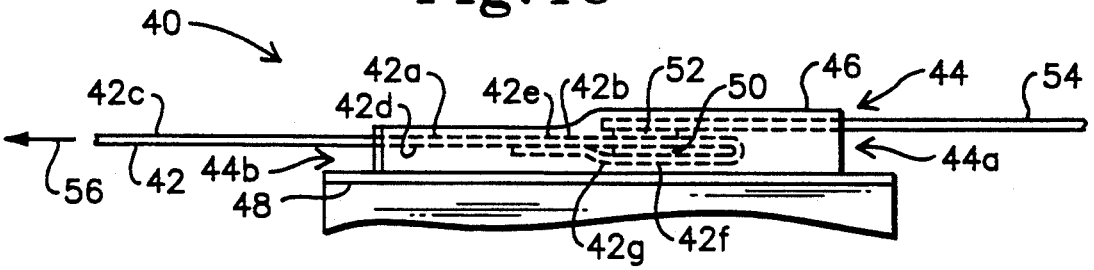

In FIG. 4*d*, the end portion 42*c* of the leader 42 is gripped and pulled leftwardly as indicated by an arrow 56 such that the end portion 42*b* and loop portion 42*f* of the leader 42 and the attached end portion of the label 54 are pulled into the slot 44. This step is continued until the left end of the label 54 reaches the second end 44*b* of the slot 44 as illustrated in FIG. 4*e*.

Figure 4E:
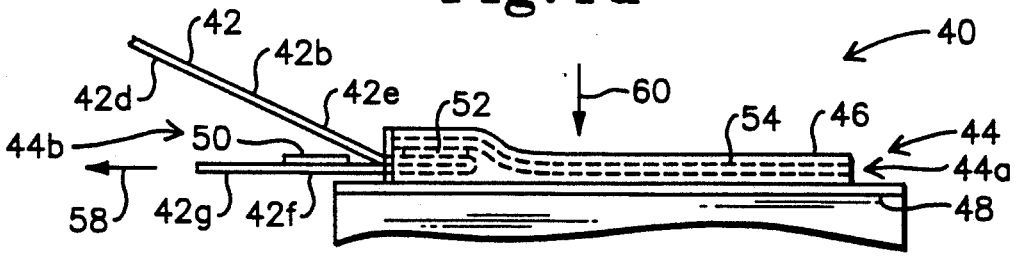

In the position of FIG. 4*e*, the release tab 42*g* and adjacent part of the loop portion 42*f* of the leader 42 protrude from the second end 44*b* of the slot 44. The leader 42 is detached from the label 54 by pulling on the tab 42*g* as indicated by an arrow 58. Where the end 44*b* of the slot 44 is completely unsealed, the label 54 can be positively prevented from being pulled out of the slot 44 through the end 44*b* by applying pressure to the overlay 46 at a position rightward of the leader 42 such as indicated by an arrow 60 to press the label 54 against the spine 48.

The force exerted on the tab 42*g* as indicated by the arrow 58 causes the loop portion 42*f* to release from the surface 42*d* of the end portion 42*b* of the leader 42 against the bonding force of the adhesive portion 50. The bonding strength of the adhesive portion 50 is selected to be great enough to prevent the loop portion 42*f* from moving relative to the end portion 42*b* in the step of FIG. 4*d*, but small enough to enable the loop portion 42*f* to release from the end portion 42*b* in the step of FIG. 4*e*.

Figure 4F:
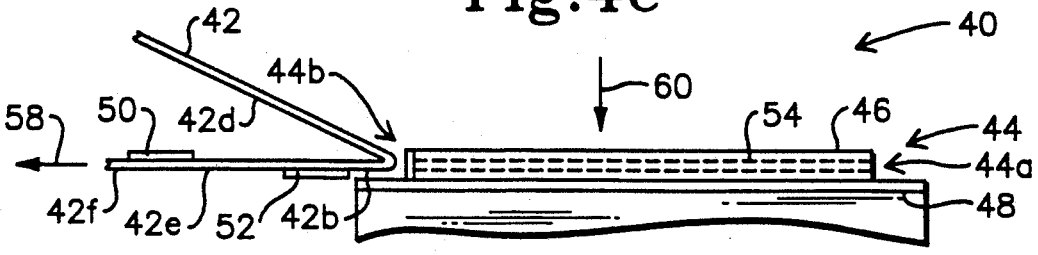

The tab 42*g* is further pulled in the direction of the arrow 58 such that the end portion 42*b* of the leader 42 releases from the label 54 against the bonding force of the adhesive portion 52, and the leader 42 detaches from the label 54 and the body of the binder 40 as illustrated in FIG. 4*f*. The bonding force of the adhesive portion 52 is selected to be large enough that the end portion 42*b* of the leader 42 will not detach from the label 54 in the step of FIG. 4*d*, but small enough that the end portion 42*b* will release from the label 54 in the steps of FIGS. 4*e* and 4*f*.

Figures 3A, 3B, 3C, 3D:
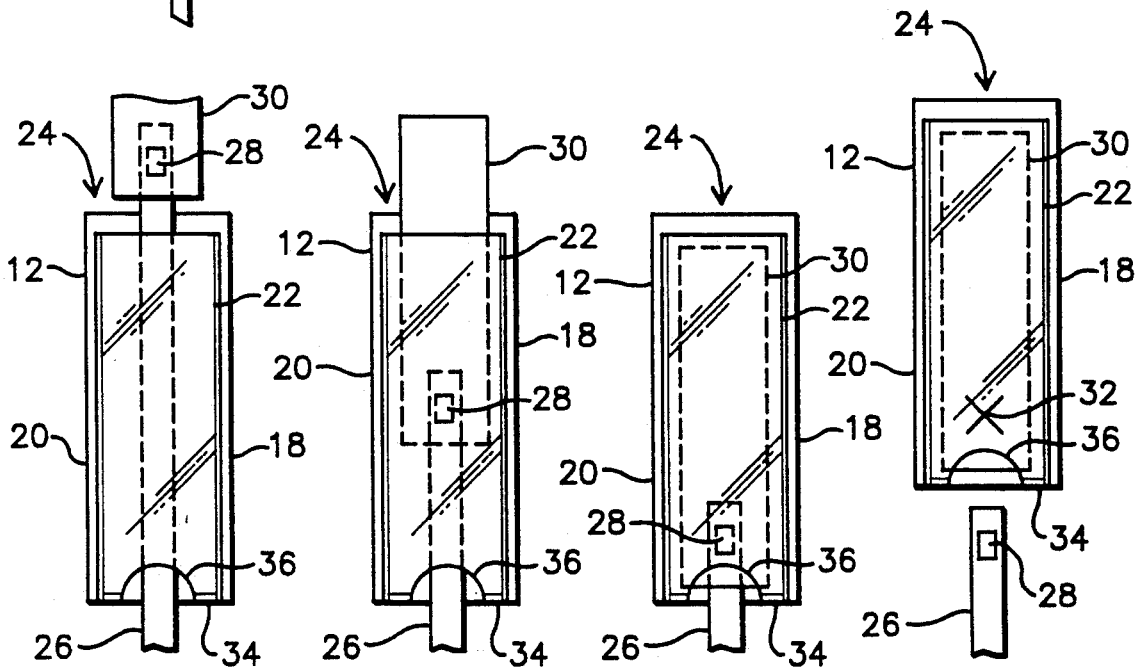
Fig.3a Fig.3b Fig.3c Fig.3d (Prior Art)
FIGS. 3*a* to 3*d* are simplified front elevational views illustrating the use of the binder and label leader assembly of FIGS. 1 and 2.

The manner in which the present leader 42 detaches from the label 54 is different from that of my prior arrangement. In the step of FIG. 3*d* in my prior arrangement, the leader 26 is caused to detach from the label 30 by shear force. In the steps of FIGS. 4*e* and 4*f* of the present arrangement, the adhesive portion 52 is caused to progressively peel off the label 54 by a tensile force which is generally perpendicular to the label 54. This causes the adhesive portion 52 to easily and smoothly release from the label 54 without tearing either the label 54 or the leader 42, even if the loop portion 42*f* is jerked roughly by a careless user.

Figure 5A:
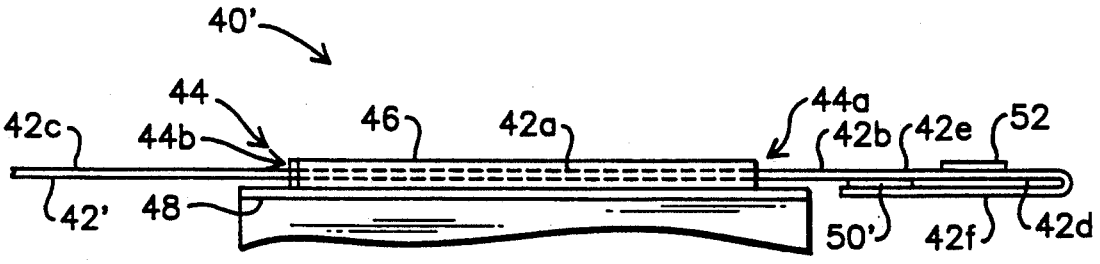
FIGS. 5*a* and 5*b* are similar to FIGS. 4*b* and 4*e* respectively illustrating a second embodiment of the present label leader.
Figure 5B:
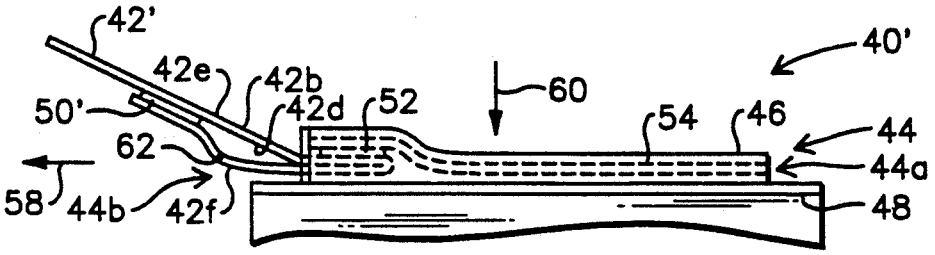

FIGS. 5*a* and 5*b* illustrate a binder 40' including a second label leader 42' embodying the present invention. Like elements are designated by the same reference numerals used in FIGS. 4*b* and 4*e*, whereas similar but modified elements are designated by the same reference numerals primed.

The leader 42' differs from the leader 42 in that the release tab 42*g* is omitted and the end of the loop portion 42*f* is permanently adhered to the surface 42*d* of the end portion 42*b* by an adhesive portion 50'. The leader 42' is released from the label 54 by gripping the loop portion 42*f* at a point 62 between the adhesive portion 50' and the end 44*b* of the slot 44, and pulling the loop portion 42*f* in the direction of the arrow 58 as in FIG. 4*e*.

Figure 6A:
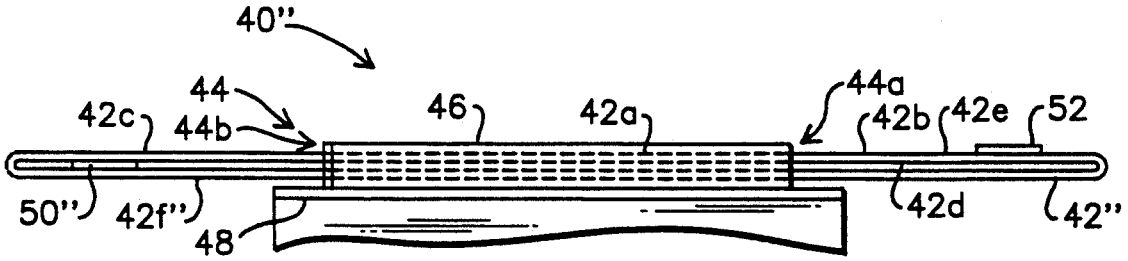
FIGS. 6*a* and 6*b* are similar to FIGS. 5*a* and 5*b* respectively illustrating a third embodiment of the present label leader.
Figure 6B:
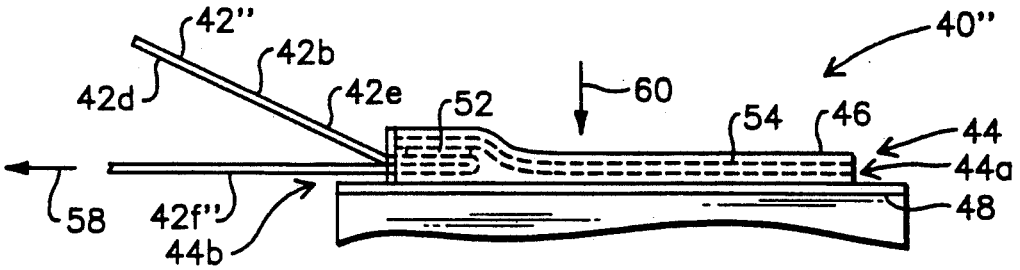

FIGS. 6*a* and 6*b* illustrate another binder 40'' including a third label leader 42'' embodying the invention. Like elements are designated by the same reference numerals used in FIGS. 4*b* and 4*f*, whereas similar but modified elements are designated by the same reference numerals double primed.

The leader 42'' differs from the leader 42 in that a loop portion 42*f''* thereof is elongated, extends through the slot 44 and protrudes from the end portion 44*b* thereof, and is attached to the second end portion 42*c* by an adhesive portion 50''. Alternatively, the ends of the loop portion 42*f''* and second end portion 42*c* can be joined together as illustrated in broken line such that the leader 42'' constitutes a continuous loop.

The label 54 is pulled into the slot 44 by gripping and pulling the second end portion 42*c* and the left part of the loop portion 42*f''* together. The leader 42'' is detached from the label 54 by pulling on the loop portion 42*f''* as illustrated in FIG. 6*b*.

It is further within the scope of the invention to omit the adhesive portion 50'' from the leader 42'', and/or to provide an additional adhesive portion at any desired location between the loop portion 42*f''* and the portion 42*a*, 42*b* and/or 42*c*.

While several illustrative embodiments of the invention have been shown and described, numerous variations and alternate embodiments will occur to those skilled in the art, without departing from the spirit and scope of the invention.

For example, although not explicitly illustrated, the leader 42 can be assembled to the binder 40 in an orientation which is opposite to that as shown in FIGS. 4*a* and 4*b*, with the adhesive portion 52 facing downwardly rather than upwardly as viewed in FIG. 4*b*. In this case, the end portion 42*c* would be folded over the end portion 42*b* of the leader 42 in FIG. 4*a*, and the label 54 would be releasably adhered to the downwardly facing surface rather than the upwardly facing surface of the leader in FIG. 4*c*.

Accordingly, it is intended that the present invention not be limited solely to the specifically described illustrative embodiments. Various modifications are contemplated and can be made without departing from the spirit and scope of the invention as defined by the appended claims.

I claim:

1. A flexible label leader, comprising:

a first end portion having first and second opposite surfaces;

a second end portion;

a loop portion which is attached to said second end portion, extends from said first end portion and is folded back over said first surface thereof; and adhesive means provided on said second surface of said first end portion for releasably adhering a label thereto.

2. A label leader as in claim 1, further comprising adhesive means for attaching said loop portion to said second end portion.

3. A flexible label leader, comprising:
a first end portion having first and second opposite surfaces;
a second end portion;
a loop portion which extends from said first end portion and is folded back over said first surface thereof;
adhesive means provided on said second surface of said first end portion for releasably adhering a label thereto; and
means for retaining said loop portion adjacent said first surface of said first end portion, and for releasing said loop portion when desired so that said loop portion can be used to peel said leader from a label adhered thereto.

4. A label leader as in claim 3, in which said loop portion is joined to said second end portion such that the leader constitutes a continuous loop.

5. A bound work comprising:
a cover;
a transparent overlay which is sealed along its longitudinal edges to an outer surface of the cover to define a slot between the cover and the overlay which has first and second transverse ends which are at least partially open; and
a flexible label leader, including:
a central portion which extends through the slot;
a first end portion which protrudes from said first transverse end of the slot and has first and second opposite surfaces;
a second end portion which protrudes from said second transverse end of the slot;
a loop portion which extends from said first end portion and is folded back over said first surface thereof;
adhesive means provided on said second surface for releasably adhering an end portion of a label thereto; and
means for retaining said loop portion adjacent said first surface of said first end portion while the leader is pulled through said slot, and for releasing said loop portion so that said loop portion can be used to peel said leader from a label adhered thereto when the label has been pulled into place in said overlay.

6. A bound work as in claim 5, in which said first and second end portions of the leader are sufficiently long that they can be releasably adhered together by the adhesive means when they are folded back over the overlay.

7. A bound work as in claim 5, in which said loop portion of the leader further extends through the slot and protrudes from said second transverse end thereof.

8. A bound work as in claim 7, in which said loop portion is joined to said second end portion such that the leader constitutes a continuous loop.

9. A bound work as in claim 5, in which said retaining means comprises adhesive means for adhering an end of said loop portion to said first surface of said first end portion.

10. A bound work comprising:
a cover;
a transparent overlay which is sealed along its longitudinal edges to an outer surface of the cover to define a slot between the cover and the overlay which has first and second transverse ends which are at least partially open; and
a flexible label leader, including:
a central portion which extends through the slot;
a first end portion which protrudes from said first transverse end of the slot and has first and second opposite surfaces;
a second end portion which protrudes from said second transverse end of the slot;
a loop portion which extends from said first end portion and is folded back over said first surface thereof;
adhesive means provided on said second surface for releasably adhering an end portion of a label thereto; and
adhesive means for attaching said loop portion to said second end portion.

11. A bound work comprising:
a cover;
a transparent overlay which is sealed along its longitudinal edges to an outer surface of the cover to define a slot between the cover and the overlay which has first and second transverse ends which are at least partially open; and
a flexible label leader, including:
a central portion which extends through the slot;
a first end portion which protrudes from said first transverse end of the slot and has first and second opposite surfaces;
a second end portion which protrudes from said second transverse end of the slot;
a loop portion which extends from said first end portion and is folded back over said first surface thereof;
adhesive means provided on said second surface for releasably adhering an end portion of a label thereto;
a tab portion which extends from an end of said loop portion; and
adhesive means for releasably adhering said end of said loop portion to said first surface of said first end portion.

12. A flexible label leader, comprising:
a first end portion having first and second opposite surfaces;
a second end portion;
a loop portion which extends from said first end portion and is folded back over said first surface thereof;
adhesive means provided on said second surface of said first end portion for releasably adhering a label thereto;
a tab portion which extends from an end of said loop portion; and
adhesive means for releasably adhering said end of said loop portion to said first surface of said first end portion.

13. A flexible label leader, comprising:
a first end portion having first and second opposite surfaces;
a second end portion;
a loop portion which extends from said first end portion and is folded back over said first surface thereof;
adhesive means provided on said second surface of said first end portion for releasably adhering a label thereto; and
adhesive means for adhering an end of said loop portion to said first surface of said first end portion.

14. A method for inserting a label into a slot defined between a cover of a bound work and a transparent overlay which is sealed along its longitudinal edges to an outer surface of the cover, the slot having first and second transverse ends which are at least partially open, comprising the steps of:

(a) providing a flexible label leader including: a central portion which extends through the slot; a first end portion which protrudes from said first transverse end of the slot and has first and second opposite surfaces; a second end portion which protrudes from said second transverse end of the slot; a loop portion which extends from said first end portion and is folded back over said first surface thereof; releasable adhesive means provided on said second surface; and means for retaining said loop portion adjacent said first surface of said first end portion when the leader is pulled through said slot;

(b) adhering an end portion of the label to the adhesive means;

(c) pulling said second end portion of the leader to thereby pull the label into said slot such that part of said loop portion of the leader protrudes from said second transverse end of the slot; and (d) further pulling said part of said loop portion such that said adhesive means is peeled from said end portion of the label and the leader is pulled clear of the label and the bound work.

15. A method as in claim 14, in which step (d) further comprises applying pressure through the overlay to press the label against the cover and thereby prevent the label from being pulled out of the slot through said second transverse end thereof.

* * * * *